US007043168B2

(12) United States Patent
Arakawa

(10) Patent No.: US 7,043,168 B2
(45) Date of Patent: May 9, 2006

(54) IMAGE FORMING APPARATUS AND METHOD FOR DETECTING THE COLOR INFORMATION AND POSITIONS OF DEVELOPING UNITS

(75) Inventor: Masaya Arakawa, Kanagawa-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 57 days.

(21) Appl. No.: 10/826,406

(22) Filed: Apr. 19, 2004

(65) Prior Publication Data

US 2005/0232645 A1 Oct. 20, 2005

(51) Int. Cl.
*G03G 15/00* (2006.01)

(52) U.S. Cl. ..... 399/12; 399/13; 399/119; 399/226; 399/227

(58) Field of Classification Search ..... 399/12, 399/13, 24, 25, 27, 28, 111, 112, 119, 223, 399/226, 227, 258, 262, 263
See application file for complete search history.

(56) References Cited

U.S. PATENT DOCUMENTS 5,049,930 A 9/1991 Okano et al.
6,915,094 B1 * 7/2005 Tsuruya et al. ..... 399/227

FOREIGN PATENT DOCUMENTS

JP 60-52878 A 3/1985
JP 8-146701 A 6/1996
JP 11-258901 A 9/1999

* cited by examiner

*Primary Examiner*—Hoang Ngo
(74) *Attorney, Agent, or Firm*—Foley & Lardner LLP

(57) ABSTRACT

An image forming apparatus and method for reproducing an image includes a plurality of color developing units, and a developing unit detector configured to detect a type and a position of each of the plurality of color developing units. A printer control unit controls the reproduction of the image based on the type and position of each of the plurality of color developing units detected by the developing unit detector.

14 Claims, 4 Drawing Sheets

IMAGE FORMING APPARATUS AND METHOD FOR DETECTING THE COLOR INFORMATION AND POSITIONS OF DEVELOPING UNITS

FIELD OF THE INVENTION

The present invention relates generally to image processing systems and, more particularly, to a system and method for detecting color information and positions of developing units.

BACKGROUND OF THE INVENTION

In a conventional color hardcopy device, such as a copier or a printer, developing units and toner cartridges are typically provided for each of four colors: yellow, magenta, cyan, and black. In such a conventional color hardcopy device, color images are formed by positioning the developing units and corresponding toner cartridges at specified locations in the device.

Further, the order for overlapping each of the four colors for generating the color images is fixed and predetermined in conventional color hardcopy devices. As a result, correct color images cannot be obtained unless a user positions the developing units at specified locations. In addition, any incorrect positioning must be corrected. Such a correction can result in contamination of the inside of the machine body and cause the printed images to become dirty.

SUMMARY OF THE INVENTION

According to an aspect of the invention, an image forming apparatus and method for reproducing an image includes a plurality of color developing units, and a developing unit detector configured to detect a type and a position of each of the plurality of color developing units. A printer control unit controls the reproduction of the image based on the type and position of each of the plurality of color developing units detected by the developing unit detector.

Further features, aspects and advantages of the present invention will become apparent from the detailed description of preferred embodiments that follows, when considered together with the accompanying figures of drawing.

DETAILED DESCRIPTION OF THE PREFERRED EMBODIMENT

Figure 1:
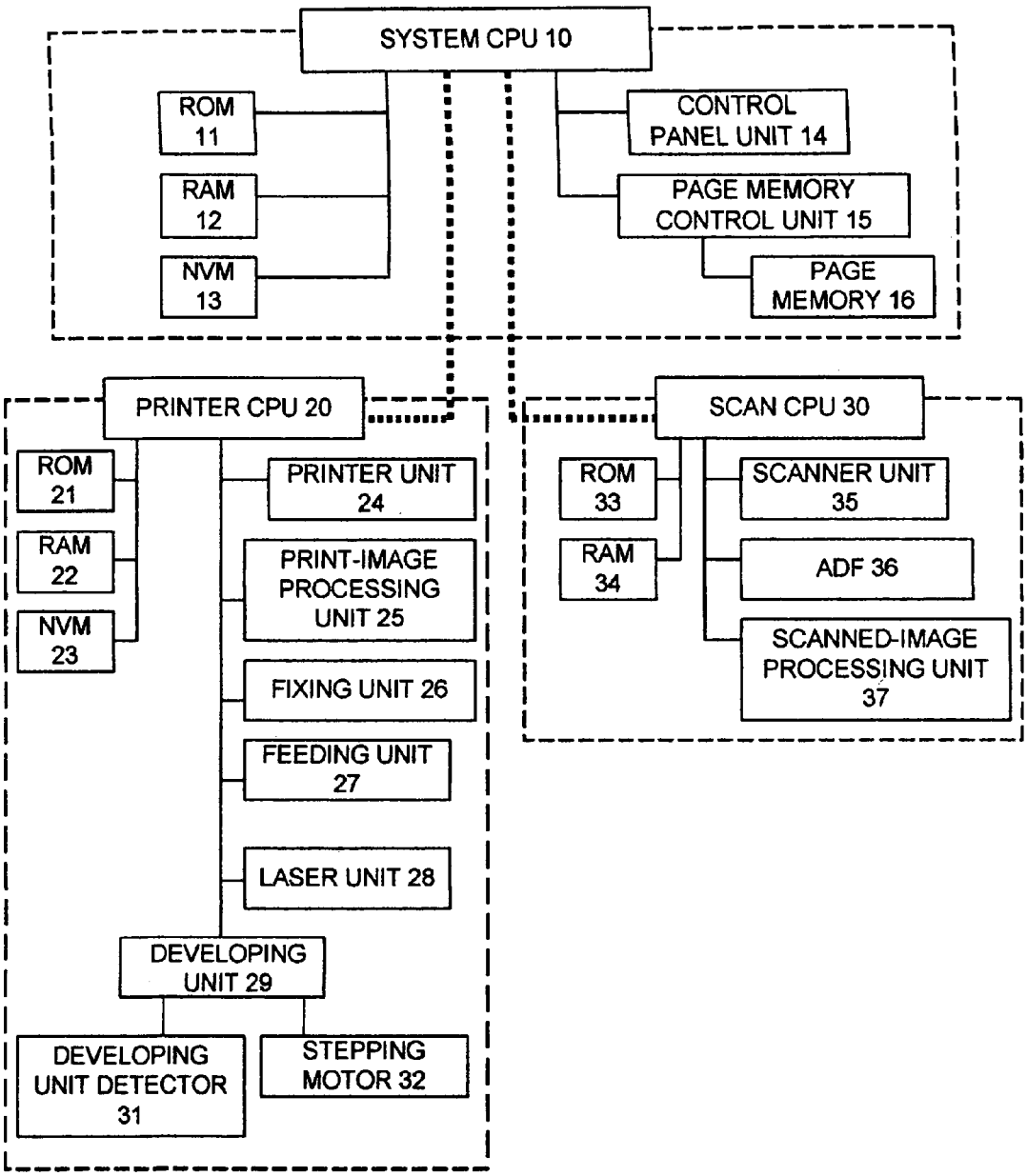
FIG. 1 is a block diagram of a hardcopy device consistent with the present invention.

FIG. 1 is a block diagram of a hardcopy device consistent with the present invention. As shown in FIG. 1, the hardcopy device includes three CPU units: a system CPU 10, a print CPU 20, and a scan CPU 30. The system CPU 10 can communicate serially (or in parallel) with the print CPU 20 and direct operations to be performed by the print CPU 20. The print CPU 20 processes print operations according to the direction from the system CPU 10, and reports the operation status to the system CPU 10. The scan CPU 30 can communicate serially (or in parallel) with the system CPU 10. The scan CPU 30 scans images according to direction from the system CPU 10, and reports the operation status to the system CPU 10.

The system CPU 10 receives the operation status information, which allows the system CPU 10 to continuously be aware of the status of the hardcopy device and control the hardcopy device based on the status and commands inputted by a control panel. The system CPU 10 has a ROM 11 which stores an operational program, a RAM 12 which loads the operational program from the ROM 11 during operation, and a non-volatile RAM (NVM) 13, which saves information particular to the hardcopy device. The system CPU 10 is also connected with a control panel unit 14, a page memory control unit 15, and a page memory 16. The system CPU 10 directs operations according to information received from the control panel unit 14, the print CPU 20, and the scan CPU 30.

The print CPU 20 also has a ROM 21 which stores an operational program, a RAM 22 which loads the operational program from the ROM 21 during operation, and a non-volatile RAM (NVM) 23, which saves information particular to the hardcopy device. The print CPU 20 is connected with a printer unit 24, a printed-image processing unit 25, a fixing unit 26, a feeding unit 27, a laser unit 28, a developing unit 29, a developing unit detector 31 and a stepping motor 32. The stepping motor 32 is a motor which can be rotated in both directions. The developing unit detector 31 is configured to detect the color and position of each color in the developing unit 29, and will be described in more detail below. The print CPU 20 controls print operations according to the directions from the system CPU 10.

The scan CPU 30 has a ROM 33 which stores an operational program, and a RAM 34 which loads the operational program from the ROM 11 during operation. The scan CPU 30 controls an image scanner unit 35, and also controls the image processing of the scanned image with a scanned-image processing unit 37. The automatic document feeder (ADF) 36 is also connected to the scan CPU 30.

Figure 2:
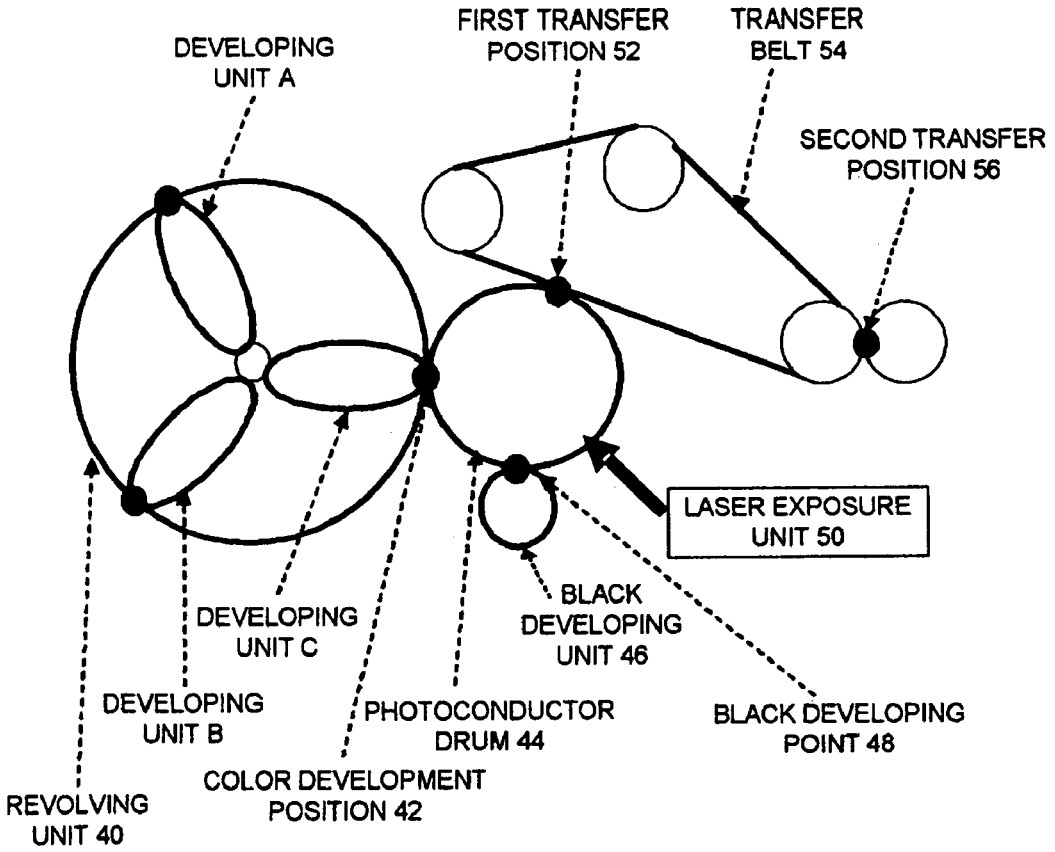
FIG. 2 is a diagram of a revolving type color developing system consistent with the present invention.

FIG. 2 is a diagram of a revolving type color developing system consistent with the present invention. As shown in FIG. 2, to form a color image, a laser exposure unit 50 exposes a laser to a photoconductor drum 44 to form a latent image. A black developing unit 46 performs black development of the color image at a black development position 48, while a revolving unit 40 performs color development of the color image at a color development position 42. At a first transfer position 52, the image developed by the revolving unit 40 and the black developing unit 46 on the drum 44 is transferred to a transfer belt 54. The image on the transfer belt 54 is transferred to a paper at a second transfer position 56.

The revolving unit 40 can be equipped with optional developing units, shown as developing unit A, developing unit B, and developing unit C in FIG. 2. The developing units A, B, and C are optionally set. After all of the developing units are set in the image forming apparatus, the revolving unit 40 is rotated in order to detect the color of each developing unit, such as cyan, magenta or yellow. By detecting the color of each developing unit, the image forming apparatus can recognize the color of each developing unit. Based on this recognition, the image forming apparatus can rotate the revolving unit 40 in a manner that enables the developing units A, B and C to develop the colors so that they overlap in a desired order, such as cyan followed by magenta followed by yellow. The desired order can be different for different image forming apparatuses or for developing different color effects that depend on the order of overlap. Although it is preferable to detect and distinguish the developing units by color, it is also possible to detect and distinguish the developing units more generally according to a type or attribute of each particular developing unit other than color. The type of developing unit may itself identify the color of the developing unit.

Figure 3:
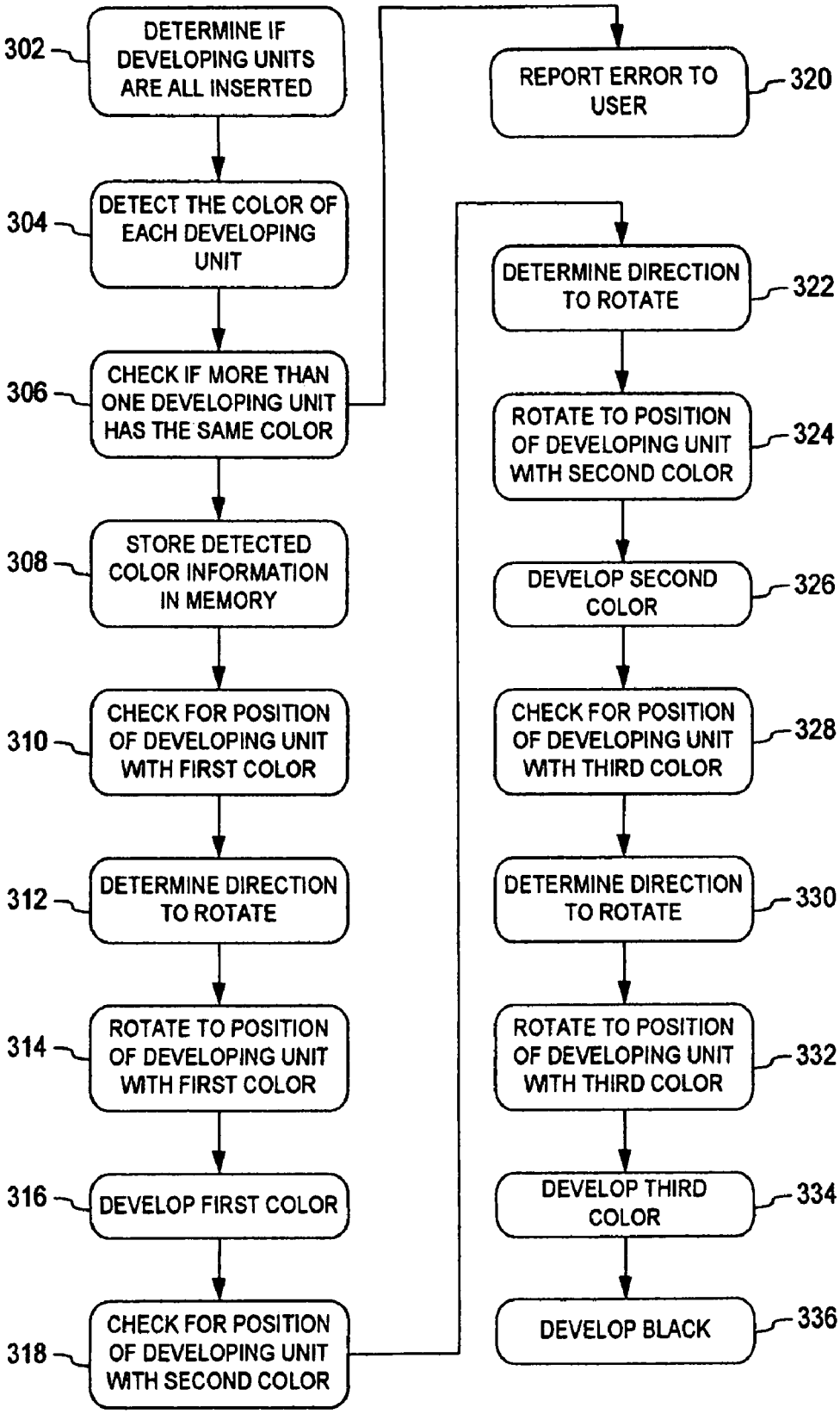
FIG. 3 is a flow diagram of a developer unit detection process consistent with the present invention.

FIG. 3 is a flow diagram of a developer unit detection process consistent with the present invention. As shown in FIG. 3, a determination is first made to see if each of the developing units are all inserted in the image forming apparatus (step 302). The determination can be made with sensors in the image forming apparatus that detect the presence or absence of a developing unit. In the following description, by way of example, it will be assumed that the image forming apparatus has a revolving unit like the revolving unit 40 of FIG. 2. It should be understood, however, that the image forming apparatus can have a different arrangement for the developing units, such as vertically one on top of the other, or horizontally one next to the other. Further, it is also possible to have the revolving unit to include the black developing unit in addition to the cyan, magenta and yellow developing units.

If all of the developing units are inserted, then the color of each developing unit is detected (step 304). The color can be detected by the developing unit detector 31, as shown in FIG. 1. There are a variety of ways in which the developing unit detector 31 can detect the color of the developing unit. In addition, as described above, other characteristics or attributes of the developing unit can be detected to distinguish the type of developing unit.

Figure 4:
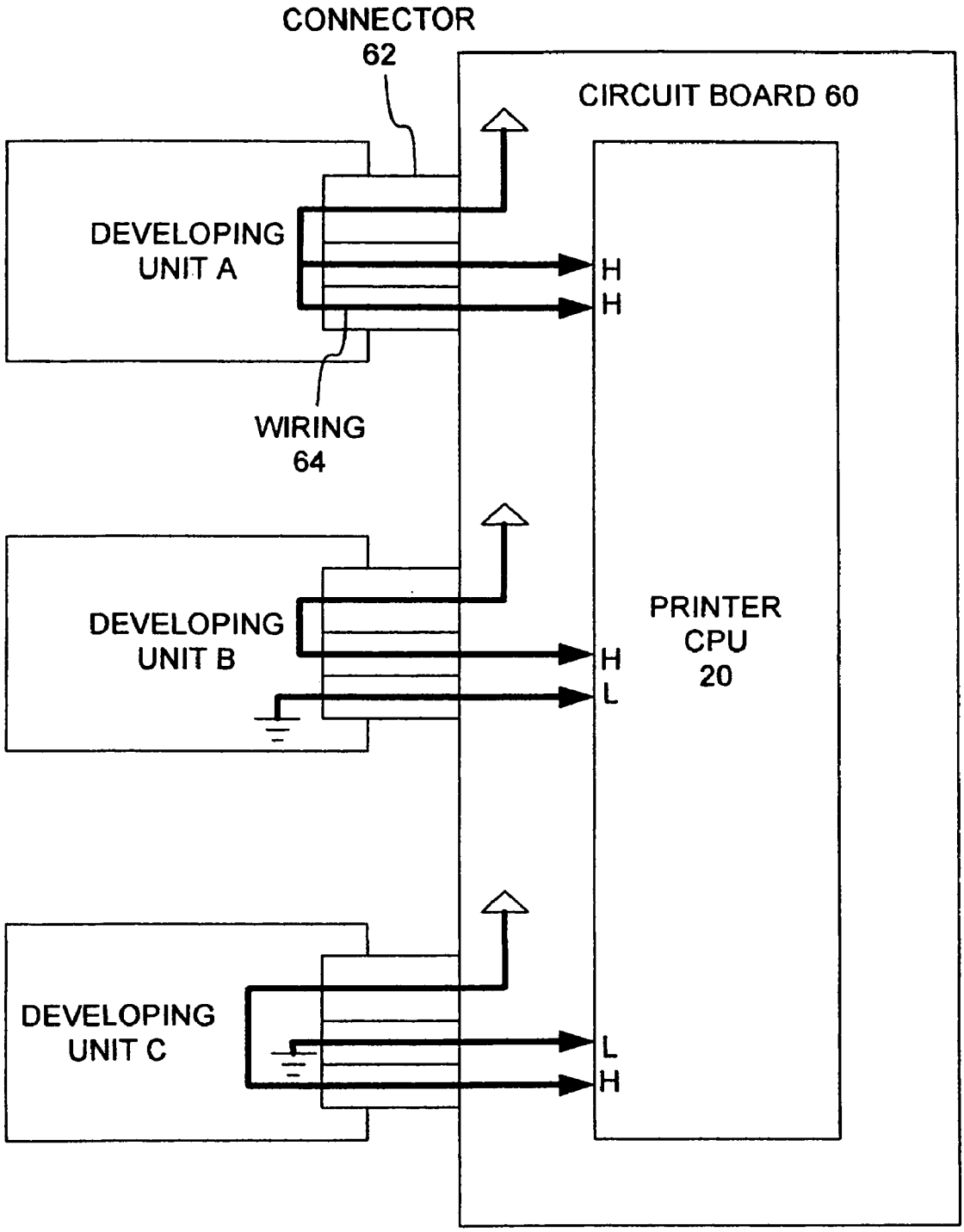
FIG. 4 is a block diagram of a developer unit detection system consistent with the present invention.

FIG. 4 is a block diagram of a developer unit detection system consistent with the present invention. As shown in FIG. 4, developing units A, B and C are each connected via a connector 62 to a circuit board 60, which includes the printer CPU 20. For each developing unit, two wirings 64 are selectively coupled to a high voltage source or ground and coupled to the printer CPU 20. The particular coupling combination is unique to each developing unit.

For example, developing unit A has both wirings 64 connected to a high voltage source, whereas developing units B and C each have one wiring connected to a high voltage source and one wiring connected to ground. The two wirings 64 from each developing unit are coupled to the printer CPU 20, which can identify the color of each developing unit based on the voltage level of the wirings 64. For example, based on the connections shown in FIG. 4, the two voltages shown below can be used to determine the color of each developing unit:

| | | |
|---|---|---|
| H | H: | Magenta |
| H | L: | Cyan |
| L | H: | Yellow |

Using this table, developing units A, B and C would be respectively identified as magenta, cyan and yellow.

There are other ways in which the developing unit color or type can be determined. For example, a projection can be attached to each of the developing units. For a revolving type unit (e.g., revolving unit 40), by attaching a projection, a switch senses the projection each time the revolving type unit is rotated and the color information of each developing unit is detected.

It is also possible to detect the color of each developing unit with toner density sensors. In particular, a density sensor can identify the density of the toner present in the developing unit. By providing different characteristics on the toner density for each color, the density sensor can detect the color of each developing unit. Instead of a density sensor, it is possible to have at least two luminescence portions with different spectral characteristics respectively and a light receiving portion, which receives light illuminated from each luminescence portion. The color of the toner in each developing unit can then be determined from the light amount detected by the light receiving portion based on the spectral characteristics of each toner color.

After detecting the color for each developing unit, a check is made to determine if more than one developing unit has the same color as another unit (step 306). For example, after detecting the color of the developing units, two units are found to have the same color, such as yellow. If, in fact, more than one developing unit has the same color as another unit, then an error is reported to the user (step 320). The error can be reported to the user, for example, through a display panel on the image forming apparatus, through a message to a PC connected to the image forming apparatus, or through a voice message played by the image forming apparatus.

If each developing unit is different, then the detected colors for each developing unit, as well as the position of the developing units, is stored in memory (step 308). The memory can be a RAM, such as RAM 12 or RAM 22 of FIG. 1, or a non-volatile storage area, such as NVM 13 or NVM 23 of FIG. 1. The information stored in the memory may be, for example, a table that lists the color for each developing unit position. This information can then be used by the image forming apparatus to control the overlapping order of the colors in accordance with a desired order.

Once a user selects a print or copy operation for a color document, the system checks for the position of the developing unit with the first color of the desired overlapping order (step 310). The check can be made by reference to the information stored in the memory that identifies the color for each developing unit and its corresponding position. For ease of description, the developing order will be considered to be cyan, magenta, and yellow, as an example. However, as described above, it should be understood that the developing order can differ among different image forming apparatuses. For example, the developing order may be yellow, cyan, and magenta.

Accordingly, assuming that cyan is the first color in the developing order, the system then determines which direction to rotate the revolving unit 40 to put the cyan developing unit in position to develop the cyan portion of the image (step 312). The direction of rotation can be forward or backward, under the control, for example, of the stepping motor 32. As described above, if the image forming apparatus has a non-revolving unit type design, this determination of which direction to rotate is not needed. Rather, the system would identify the developing unit having cyan and activate that developing unit to develop the cyan portion of the image.

Under the control of the stepping motor 32, the revolving unit 40 is rotated in the determined direction to put the cyan developing unit at the color developing position 42 (step 314). Once the cyan developing unit is at the color developing position 42, the cyan portion of the image is developed (step 316).

These steps are then repeated for the other developing units in accordance with the desired overlapping order. Assuming the second color is magenta, the system checks for the position of the magenta developing unit, which is the second color of the desired overlapping order (step 318). The system then determines which direction to rotate the revolving unit 40 to put the magenta developing unit in position to develop the magenta portion of the image (step 322). Under the control of the stepping motor 32, the revolving unit 40 is rotated in the determined direction to put the magenta developing unit at the color developing position 42 (step 324). Once the magenta developing unit is at the color developing position 42, the magenta portion of the image is developed (step 326).

Finally, assuming the third color in the desired overlapping order is yellow, the system checks for the position of the yellow developing unit (step 328). The system then determines which direction to rotate the revolving unit 40 to put the yellow developing unit in position to develop the yellow portion of the image (step 330). Under the control of the stepping motor 32, the revolving unit 40 is rotated in the determined direction to put the yellow developing unit at the color developing position 42 (step 332). Once the yellow developing unit is at the color developing position 42, the yellow portion of the image is developed (step 334). After the three color portions of the image are developed, the black portion of the image is developed by the black developing unit 46 at the black developing point 48 (step 336).

In accordance with this invention, it is possible control the order of color development even if the developing units are not placed as specified. In other words, a correct color image can be generated without being affected by the location in which the developing units are positioned. It is therefore possible to arranged the developing units freely or randomly without consideration of a specific placement for each unit and still achieve a correct color image.

The foregoing description of a preferred embodiment of the invention has been presented for purposes of illustration and description. It is not intended to be exhaustive or to limit the invention to the precise form disclosed, and modifications and variations are possible in light in the above teachings or may be acquired from practice of the invention. The embodiments (which can be practiced separately or in combination) were chosen and described in order to explain the principles of the invention and as practical application to enable one skilled in the art to utilize the invention in various embodiments and with various modifications are suited to the particular use contemplated. It is intended that the scope of the invention be defined by the claims appended hereto and their equivalents.

What is claimed is:

1. A method for reproducing an image in an image forming apparatus comprising a plurality of color developing units, comprising:

detecting a type and a position of each of the plurality of color developing units;

storing the detected type and position of each of the plurality of color developing units in a storage unit in the image forming apparatus; and reproducing the image based on the detected type and position of each of the plurality of color developing units.

2. A method according to claim 1, wherein the image is reproduced based on the detected type and position of each of the plurality of color developing units stored in the storage unit.

3. A method according to claim 1, wherein the type of the color developing unit identifies the color of the color developing unit.

4. A method according to claim 3, further comprising:

determining whether the color of more than one of the plurality of color developing units is the same; and generating an error signal if it is determined that the color of more than one of the plurality of color developing units is the same.

5. A method according to claim 3, further comprising:

determining whether the color of more than one of the plurality of color developing units is the same; and notifying a user of the image forming apparatus if it is determined that the color of more than one of the plurality of color developing units is the same.

6. A method according to claim 3, wherein the color developing units are installed in a revolving unit, the method further comprising:

identifying a color to be developed;

determining the position of the color developing unit corresponding to the identified color based on the detected type and position of each of the plurality of color developing units; and rotating the revolving unit to place the color developing unit corresponding to the identified color at a developing position.

7. A method according to claim 6, wherein each of the color developing units perform their respective developing in a predetermined order, and wherein the revolving unit is rotated to place each of the color developing units at the developing position in accordance with the predetermined order.

8. An image forming apparatus for reproducing an image, comprising:

a plurality of color developing units;

a developing unit detector configured to detect a type and a position of each of the plurality of color developing units;

a storage unit configured to store the detected type and position of each of the plurality of color developing units; and a printer control unit configured to control the reproduction of the image based on the type and position of each of the plurality of color developing units detected by the developing unit detector.

9. An image forming apparatus according to claim 8, wherein the printer control unit image controls the reproduction of the image based on the detected type and position of each of the plurality of color developing units stored in the storage unit.

10. An image forming apparatus according to claim 8, wherein the type of the color developing unit identifies the color of the color developing unit.

11. An image forming apparatus according to claim 10, wherein the developing unit detector is further configured to determine whether the color of more than one of the plurality of color developing units is the same and generate an error signal if it is determined that the color of more than one of the plurality of color developing units is the same.

12. An image forming apparatus according to claim 10, wherein the developing unit detector is further configured to determine whether the color of more than one of the plurality of color developing units is the same and notify a user of the image forming apparatus if it is determined that the color of more than one of the plurality of color developing units is the same.

13. An image forming apparatus according to claim 10, further comprising a revolving unit upon which the color developing units are installed, wherein the printer control unit is further configured to rotate the revolving unit to place a color developing unit corresponding to a color to be developed at a developing position in accordance with the position of the color developing unit corresponding to the color to be developed as detected by the developing unit detector.

14. An image forming apparatus according to claim 13, wherein each of the color developing units perform their respective developing in a predetermined order, and wherein the printer control unit rotates the revolving unit to place each of the color developing units at the developing position in accordance with the predetermined order.

* * * * *